United States Patent [19]

Morales

[11] 4,185,339

[45] Jan. 29, 1980

[54] WATER CLOSET TANK AND INCLINED OUTLET VALVE BALL ELEMENT SUPPORT THEREFOR

[76] Inventor: Juan A. Morales, P.O. Box 14, El Palo, Malaga, Spain

[21] Appl. No.: 848,013

[22] Filed: Nov. 2, 1977

[51] Int. Cl.[2] ..... E03D 1/30; E03D 1/35; E03D 5/09

[52] U.S. Cl. ..... 4/378; 4/393; 4/398; 4/414; 4/427

[58] Field of Search ..... 4/366, 378, 392–401, 4/405, 411, 413, 414, 427, 205, DIG. 1; 137/448

[56] References Cited

U.S. PATENT DOCUMENTS

| | | | |
|---|---|---|---|
| 2,189,345 | 2/1940 | Hillegas | 4/396 |
| 2,643,393 | 6/1953 | Karr | 4/393 |
| 2,824,571 | 2/1958 | Skerritt | 137/448 |
| 2,892,197 | 6/1959 | Flieder | 4/393 |
| 2,962,727 | 12/1960 | Kanter et al. | 4/392 X |
| 3,148,381 | 9/1964 | Morales | 4/396 |
| 3,466,672 | 9/1969 | McGahee | 4/396 |

*Primary Examiner*—Stuart S. Levy
*Attorney, Agent, or Firm*—Clarence A. O'Brien; Harvey B. Jacobson

[57] ABSTRACT

A flush tank is provided including a lower outlet opening and internal structure for guided movement of a free spherical buoyant valve ball into seated position in the outlet opening of the tank after the flush water has been drained therefrom. The tank includes a float controlled water inlet valve and float operated structure for at least partially unseating the valve ball from the water outlet in response to the level of water within the tank exceeding a predetermined maximum established by the float controlled water inlet valve, in the event of a malfunction of the water inlet valve to completely terminate the entrance of water into the tank as the level of water reaches the aforementioned predetermined maximum. Further, the lower outlet opening includes an upwardly facing annular concave spherical seat of the same radius of curvature as the valve ball and the seat is defined by a tapering peripheral lip portion of a resilient valve ball seat.

7 Claims, 17 Drawing Figures

Fig. 7
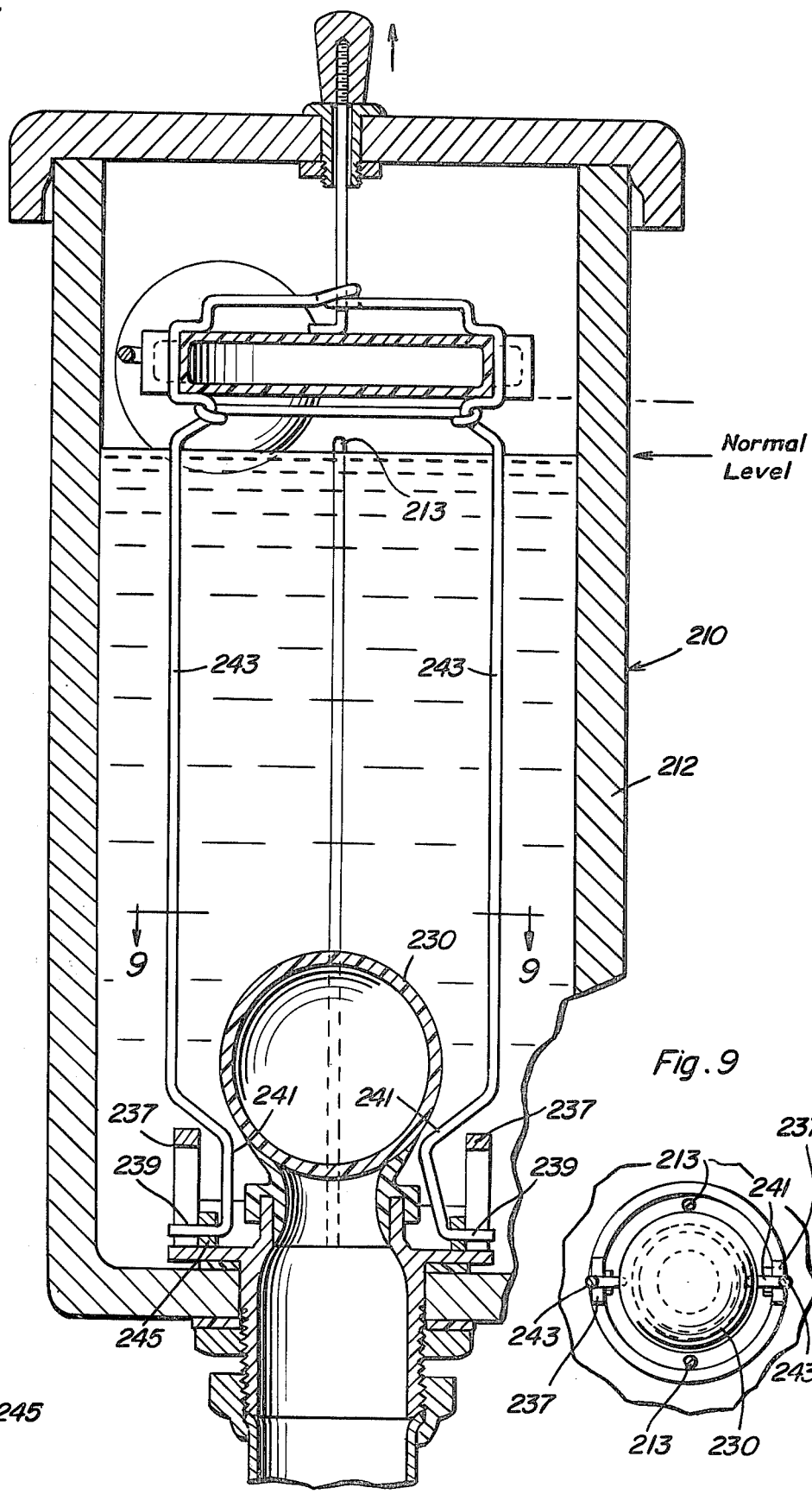
Fig. 8
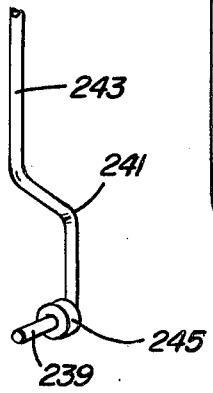
Fig. 9

WATER CLOSET TANK AND INCLINED OUTLET VALVE BALL ELEMENT SUPPORT THEREFOR

BACKGROUND OF THE INVENTION

The instant invention comprises an improvement over the water tank and outlet valve construction disclosed in my prior U.S. Pat. No. 3,148,381. The basic structure of the instant invention is very similar to the structure of my prior patented tank and outlet valve structure, but the latter does not include means whereby excess water supplied to the interior of the tank through the inlet valve therefor may be discharged therefrom in order to prevent tank overflow. Still further, my previous invention relied solely upon sloped lower supporting surfaces for guiding the valve ball back into seated engagement with the outlet opening upon the flush water being drained from the tank.

BRIEF DESCRIPTION OF THE INVENTION

The flush tank construction of the instant invention includes a free valve ball engageable in a downwardly opening lower outlet to terminate the flow of flush water from a flush tank as the level of water is lowered to the outlet. In addition, float controlled structure is provided for admitting water into the tank to replenish the supply of flushing water and further structure is provided to at least partially unseat the valve ball from the water outlet in response to water being admitted into the tank to a level above a predetermined maximum, whereby the excess water admitted into the tank may be drained therefrom.

The main object of this invention is to provide a flush tank including water drain, inlet and overflow controlling structure utilizing extremely simple components for rendering substantially totally effective operation over very long periods of use.

Another object of this invention, in accordance with the immediately preceding object, is to provide a water outlet valve structure for a flush tank including a free valve ball seatable in a downwardly opening flush water outlet of the tank to terminate the discharge of flush water from the tank.

Another important object of this invention is to provide structure whereby the free valve ball will be properly guided into position in seated engagement with the flush tank outlet whenever the level of water within the flush tank drops below a predetermined lower level.

Another object of this invention is to provide float controlled structure whereby the valve ball may be at least partially unseated from the outlet for the flush tank in response to the level of water within the tank being elevated above a predetermined maximum.

Still another object of this invention is to provide a flush tank including a low level water inlet controlling valve of dependable operation.

A still further object of this invention is to provide a novel overflow siphon tube for a flush tank.

Yet another important object of this invention is to provide a flush tank including a flushing mechanism which may not be readily actuated by toddler-age children in a playful manner.

A final object of this invention to be specifically enumerated herein is to provide a flush tank construction in accordance with the preceding objects and which will conform to conventional forms of manufacture, be of simple construction and easy to use, so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 7 is an enlarged, fragementary, transverse, vertical sectional view of a third form of flush tank construction;

FIG. 8 is a fragmentary, perspective view of one side portion of the vertically shiftable valve ball unseating structure of the third form of the invention illustrated in FIG. 7;

FIG. 9 is a fragmentary, horizontal sectional view taken substantially upon the plane indicated by the section line 9—9 of FIG. 7 and on somewhat of a reduced scale;

DETAILED DESCRIPTION OF THE PREFERRED EMBODIMENTS

Figure 1:
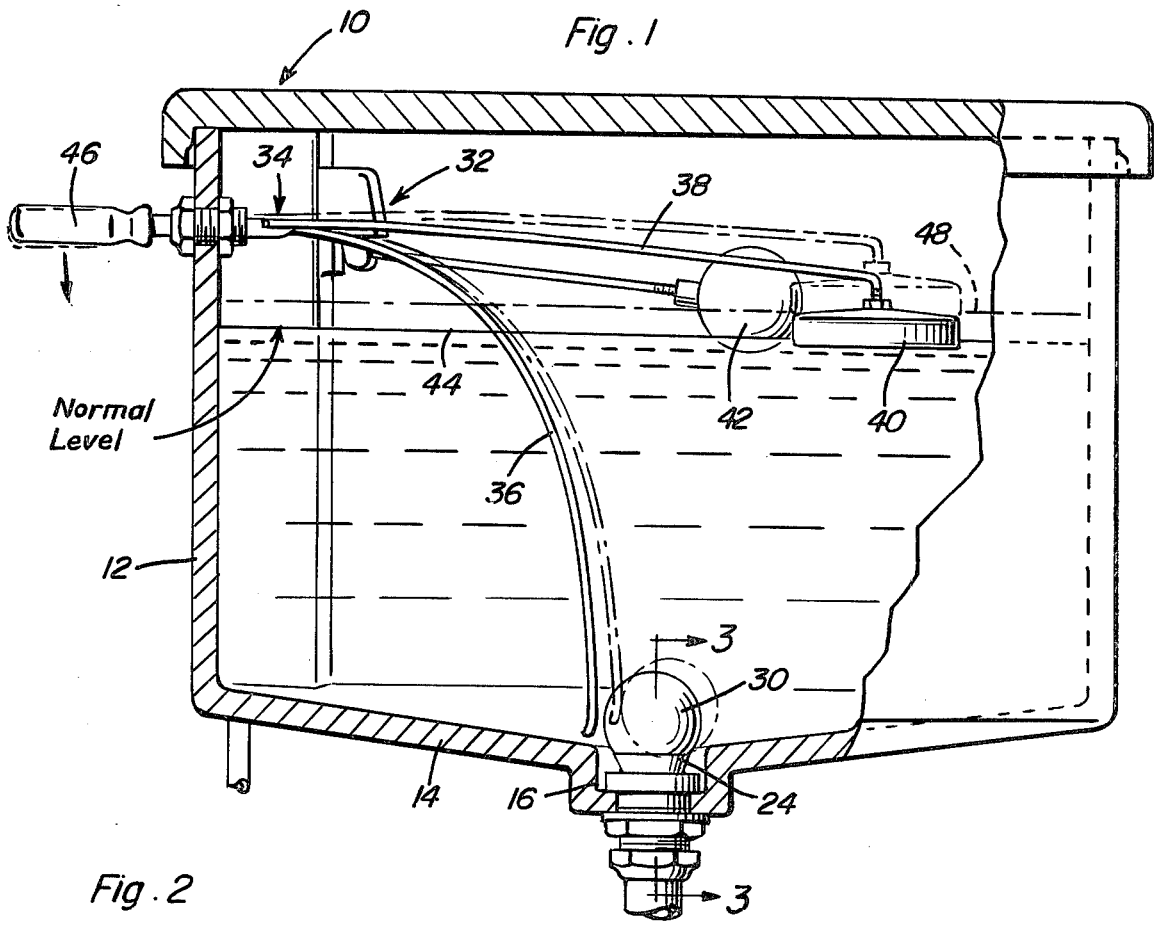
FIG. 1 is a front elevational view of a first form of flush tank construction in accordance with the present invention and with portions of the flush tank being broken away and illustrated in vertical section.
Figure 2:
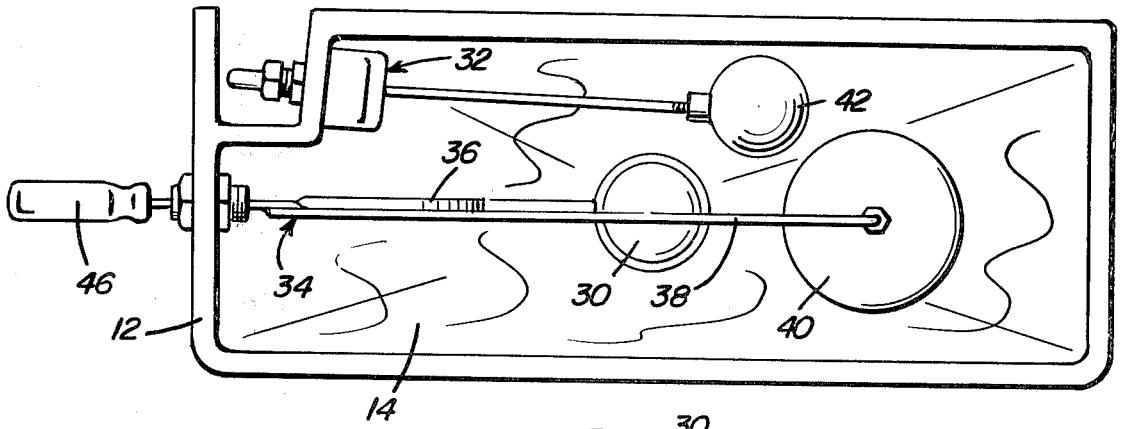
FIG. 2 is a top plan view of the assemblage illustrated in FIG. 1 with the top of the tank removed.
Figure 3:
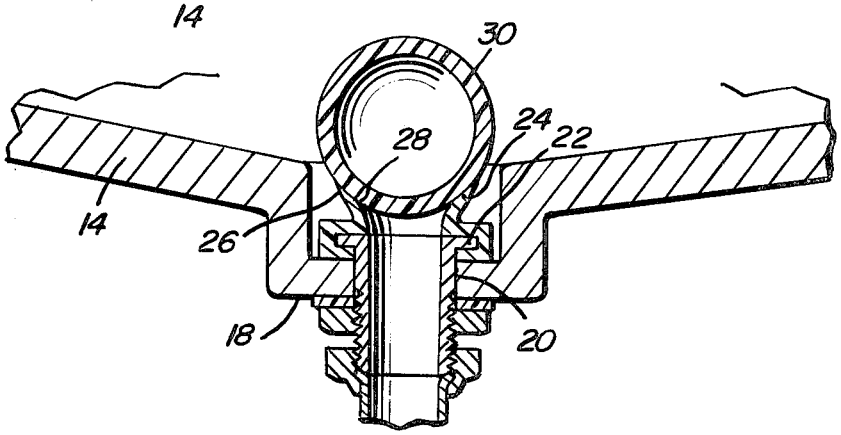
FIG. 3 is an enlarged, fragmentary, transverse, vertical sectional view taken substantially upon the plane indicated by the section line 3—3 of FIG. 1.

Referring now more specifically to the drawings, the numeral 10 generally designates the flush tank construction of the instant invention. The flush tank construction 10 includes an upwardly opening tank 12 including a bottom wall 14 whose upper surfaces slope downwardly toward a central well 16 including a centrally apertured bottom wall 18 through which a gravity drain outlet fitting 20 is secured in fluid tight sealed engagement with the bottom wall 18. The fitting 20 includes an upper end outwardly projecting circumferential flange 22 with which a tubular valve seat 24 constructed of resilient material is removably sealingly engaged. The valve seat 24 is tapered as at 26 and defines an annular, partial and upwardly opening concave spherical valve seating surface 28 with which a buoyant and resilient spherical valve ball 30 is removably seatingly engaged to prevent the flow of flushed water within the tank 12 outwardly therefrom through the outlet fitting 20.

The tank 12 includes a float controlled water inlet structure referred to in general by the reference numeral 32 and which is substantially identical to the water inlet controlling valve structure disclosed in my prior U.S. Pat. No. 3,148,381. Also, the flush tank construction 10 further includes an outlet valve ball operating structure referred to in general by the reference numeral 34 and which is substantially identical to the similar structure (120) disclosed in my above-mentioned prior patent. The structure 34, however, differs from my previous structure (120) in that the lever or arm 36 for displacing the valve ball 30 also includes an arm 38 upon whose free end a second float 40, in addition to the float 42 of the structure 32, is mounted.

In operation, the flush tank construction water inlet valve structure 32 is operative to admit water into the tank 12 at any time the level of water therein falls below the level 44. The flushing operation may be initiated by downwardly depressing the handle 46 of the structure 34 whereby the lever 36 will be swung from the solid line position thereof in FIG. 1 to the phantom line position thereof in order to fully unseat the valve ball 30 from the valve seat 24. As the valve ball 30 is unseated from the seat 24, it will float upwardly to the surface of the water within the tank 10 and the dislodgement of the valve ball 30 from the seat 24 will, of course, allow the water within the tank 12 to drain therefrom through the outlet fitting 20. As the level of water within the tank is lowered downwardly to a level close to the bottom wall 14, the valve ball 30 will be lowered into contact with the upper surfaces of the bottom wall 14 and roll by gravity toward the well 16 and into the latter in seated engagement with the valve seat surface 28. Thus, the discharge of water from the tank 12 will be terminated and the water being admitted into the tank 12 through the structure 32 will raise the water level within the tank to the level 44, whereby the float 42 of the structure 32 will close the water inlet valve structure 32 and thus terminate the entrance of water into the tank 12. If, however, for any reason the water inlet valve structure 32 is inoperative to totally terminate the entrance of water into the tank 12 after the water has reached the level 44, as soon as the level of water within the tank reaches the excess water level 48, the float 40 will be buoyed upwardly sufficiently to cause the lever 36 to again engage the valve ball 30 and to at least slightly displace the valve ball 30 from the surface 28 and thereby allow the additional amounts of water admitted into the tank 12 to slowly drain therefrom. In this manner, overflowing of the tank 12 as a result of malfunction of the water inlet valve structure 32 is eliminated.

Figure 4:
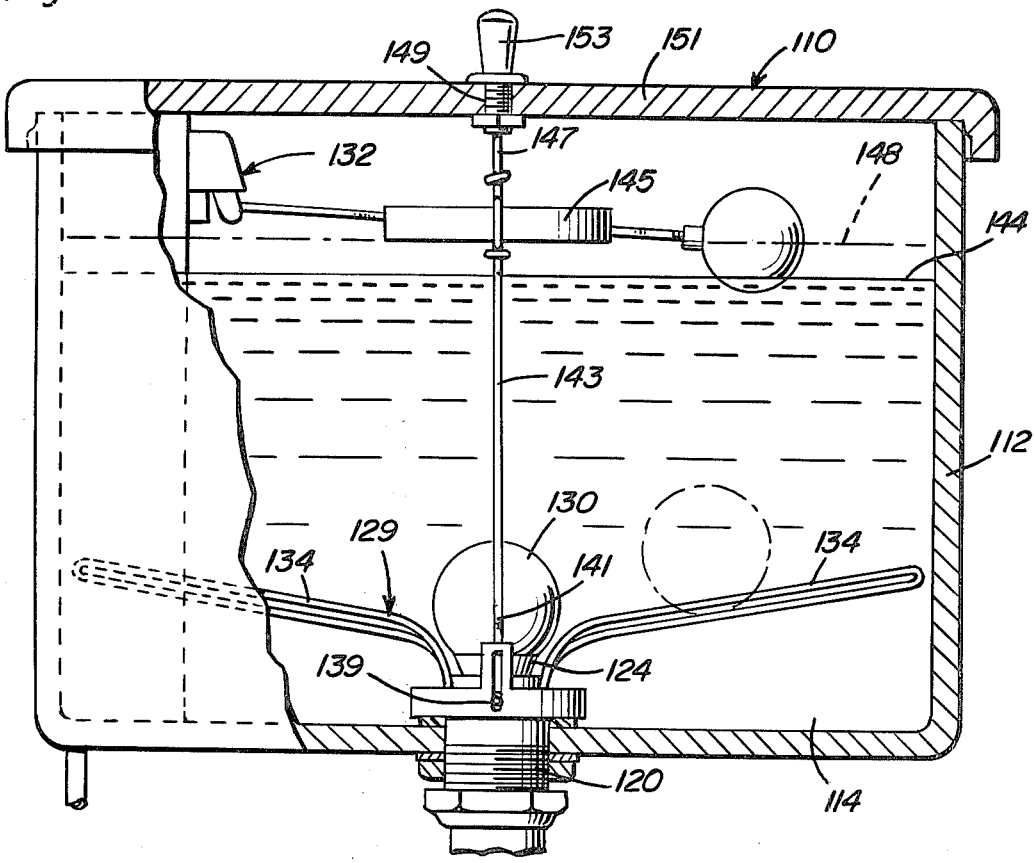
FIG. 4 is an elevational view similar to FIG. 1 but illustrating a second form of flush tank construction.
Figure 5:
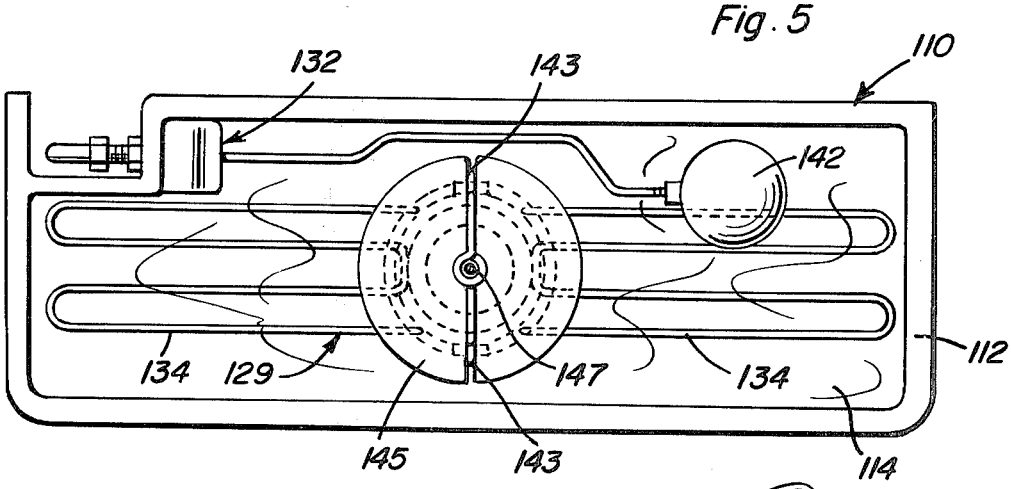
FIG. 5 is a top plan view of the assemblage illustrated in FIG. 4 with the top of the tank removed.
Figure 6:
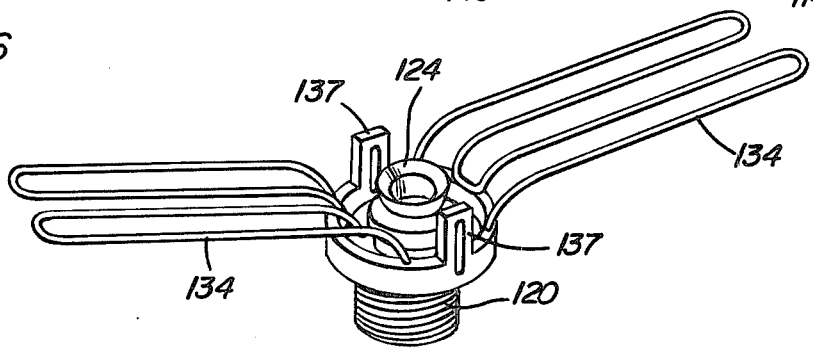
FIG. 6 is a perspective view of the water outlet construction utilized in the assemblage illustrated in FIGS. 4 and 5 and illustrating the gravity-type valve ball guiding structure thereof.
Figure 10:
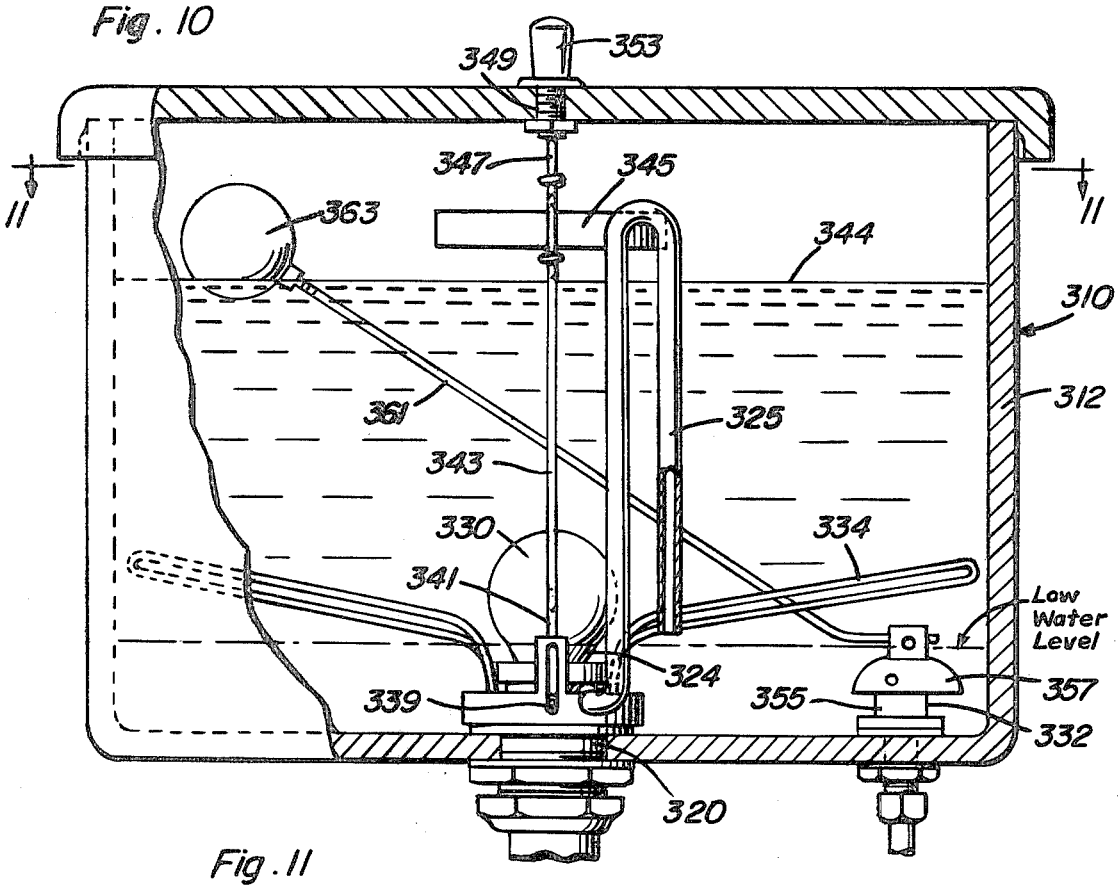
FIG. 10 is a front, elevational view of a fourth form of flush tank construction with portions of the flush tank being broken away and illustrated in vertical section.
Figure 11:
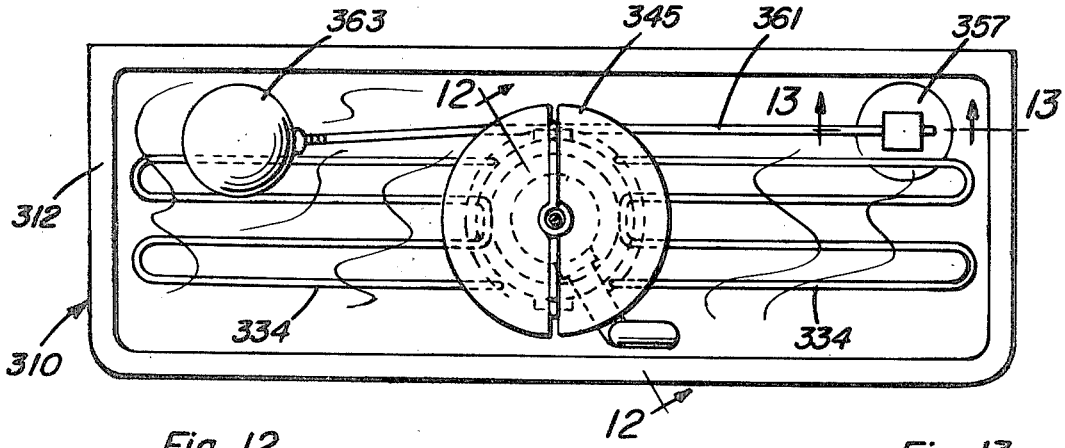
FIG. 11 is a top plan view of the assemblage illustrated in FIG. 10 with the top wall thereof removed.
Figure 12:
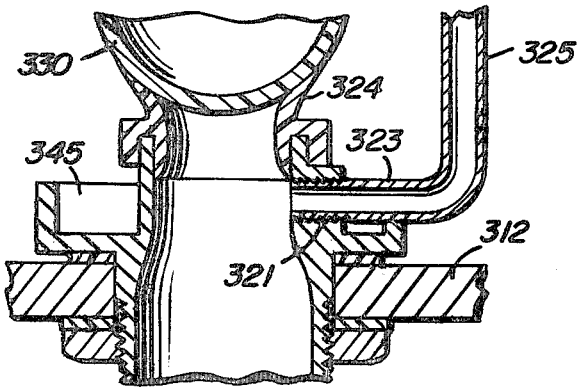
FIG. 12 is an enlarged, fragmentary, vertical sectional view taken substantially upon the plane indicated by the section line 12—12 of FIG. 11.
Figure 13:
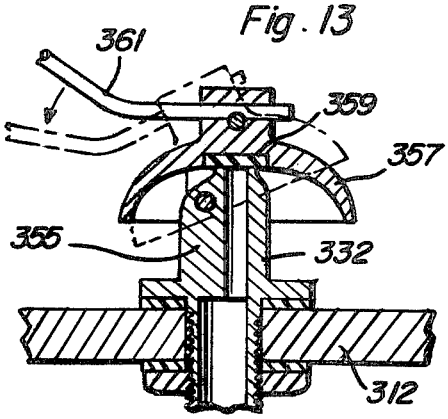
FIG. 13 is an enlarged, fragmentary, vertical sectional view taken substantially upon the plane indicated by the section line 13—13 of FIG. 11.

With attention now invited more specifically to FIGS. 4 through 6 of the drawings, a second form of flush tank construction is referred to in general by the reference numeral 110. The flush tank construction 110 includes a flush tank 112 of conventional design including a horizontal bottom wall 114 through which a fitting 120 similar to the fitting 20 is secured. The fitting 120 includes a tapered valve seat 124 corresponding to the valve seat 24, but in lieu of the sloped bottom wall surfaces of the flush tank construction 10, the flush tank construction 110 includes valve ball supporting and guiding structure referred to in general by the reference numeral 129. Further, the flush tank 110 includes a water inlet valve structure 132 similar to the structure 32.

The valve ball support and guide structure 129 includes a pair of opposite side and oppositely inclined rack sections 134 supported therefrom inclined upwardly and outwardly away from the outlet fitting 120 toward the opposite side walls of the tank 112. The rack sections 134 are of a configuration to cradle the valve ball 130 corresponding to the ball 30 and to support and guide the valve ball 130 for rolling movement toward seated engagement in the valve seat 124 as a result of the level of water within the tank 112 being lowered downwardly to the rack sections 134.

In addition, the outlet fitting 120 includes a pair of opposite side upstanding and vertically slotted guides 137 which guidingly receive out turned lower terminal ends 139 carried by inwardly directed lower end portions 141 of a pair of generally parallel rods 143 between whose upper ends a float 145 is supported. An operating rod 147 has its lower ends anchored relative to the upper ends of the rods 143 above the float 145 and the upper end of the rod 147 passes through a tubular fitting 149 secured through the removable top wall 151 of the tank 112 and has an operating knob 153 supported on the end portion thereof disposed above the top wall 151. The float 145 serves the function of the float 40 in that when the level 144 of water within the tank 112 corresponding to the water level 44 is increased to the higher level 148, the float 145 will raise the rods 143 and 147 and also the inwardly directed lower end portions 141 of the rods 143 for engagement with lower portions of the valve ball 130 to at least partially unseat the valve ball 130 from the valve seat 124 and allow excess water admitted into the tank 112 to be drained therefrom. Of course, when it is desired to actuate the flush tank construction 112 for the purpose of flushing the associated commode, the operating knob 153 is manually grasped and lifted upwardly so as to raise the rods 143 sufficiently to fully unseat the valve ball 130 from the valve seat 124 and thereby allow the buoyant valve ball 130 to float upwardly to the surface of the water within the tank 112. Of course, when the flushing operation is substantially terminated, the valve ball 130 is lowered into contact with the rack sections 134 and is guided back toward fully seated engagement with the valve seat 124 in order to terminate the flushing operation. Of course, the supply of water within the tank 112 is replenished through the water inlet valve structure 132.

With attention now invited more specifically to FIGS. 7, 8 and 9 of the drawings, a third form of flush tank construction is referred to in general by the reference numeral 210. The flush tank construction 210 is substantially identical to the flush tank construction 110, except that the rack sections 134 of the construction 110 are not provided. In lieu of the rack sections 134, a pair of diametrically opposite guide rods 213 are provided for use in conjunction with the rods 243 corresponding to the rods 143 in order to constrain vertical movement of the valve ball 230 within the tank 212. In this manner, the valve ball 230 is maintained within a vertical area bound by the rods 213 and 243.

The lower ends of the rods 243 include inwardly offset lower end portions 241 corresponding to the portions 141 and which terminate in outwardly directed terminal ends 239 corresponding to the terminal ends 139. Further, the lower terminal end portions 239 may include washers 245, if desired, inwardly of the guides 237 corresponding to the guides 137. Also, the terminal ends 139 may also include similar washers.

It may thus be seen that operation of the flush tank construction 210 is substantially identical to operation of the flush tank 110 except that the valve ball 230 is restrained for vertical movement between the rods 213 and 243 as opposed to being cradled and guided by the rack sections 134 of the tank 112.

With attention now invited more specifically to FIGS. 10 through 13 of the drawings, a fourth form of flush tank construction is referred to in general by the reference numeral 310. The flush tank construction 310 is very similar to the flush tank construction 110 and includes components 320, 324, 334, 339, 341, 343, 345, 347, 349 and 353 corresponding to components 120, 124, 134, 139, 141, 143, 145, 147, 149 and 153, respectively, of the flush tank construction 110. However, the fitting 320 includes a radial passage 321 formed therethrough in which a horizontally directed lower terminal end 323 of an inverted U-shaped overflow siphon 325 is threadingly secured. Accordingly, should the water level within the tank 312 be increased abobe the bend in the siphon 325, the excess water will flow outwardly therefrom through the overflow siphon 325. In addition, the tank construction 310 includes a lower water inlet valve 332 including an upwardly opening inlet fixture 355 from whose upper end a downwardly opening cup-shaped valve member 357 is oscillatably supported. The center portion of the valve member 357 includes a recessed resilient valve disk 359 closable over the open upper end of the inlet fitting 355 to terminate the inflow of water therethrough and the valve member 357 has the base end of a float arm 361 removably anchored thereto, the free end of the arm 361 having a float 363 supported therefrom.

The valve member 357, when swung to the open position illustrated in phantom lines, serves to downwardly deflect the entrance of water into the tank 312 and to quiet the entrance of water into the tank. However, as the water level within the tank 312 approaches the level 344, the float 363 is operative to swing the arm 361 and the valve member 357 from the open position thereof illustrated in phantom lines in FIG. 13 to the closed position thereof illustrated in solid lines in FIG. 13, thereby closing the upper end of the inlet fitting 355 to the entrance of water into the tank 312.

In order to actuate the flush tank construction 310, the knob 353 is manually grasped and lifted in the same manner that the flush tank 110 is actuated whereby the inwardly directed lower end portions 341 of the rods 343 will engage and upwardly displace the valve ball 330 from the valve seat 324.

Although the tank 310 includes the overflow siphon 325, the float 345 is still operative to partially unseat the ball 330 from the seat 324 if the level of water is raised above level 344. Thus, even if the siphon 325 is rendered inoperative for any reason, the tank 312 may not overflow since the excess water admitted thereinto will cause the float 345 to be elevated and the ball 330 to be partially unseated from the seat 324.

Referring now more specifically to FIGS. 14 through 17, there will be seen a fifth form of flush tank construction referred to in general by the reference numeral 410. The flush tank construction 410 is quite similar to the flush tank construction 310 and includes components 412, 420, 424, 447, 449 and 453 corresponding to components 312, 320, 324, 347, 349 and 353.

Figure 14:
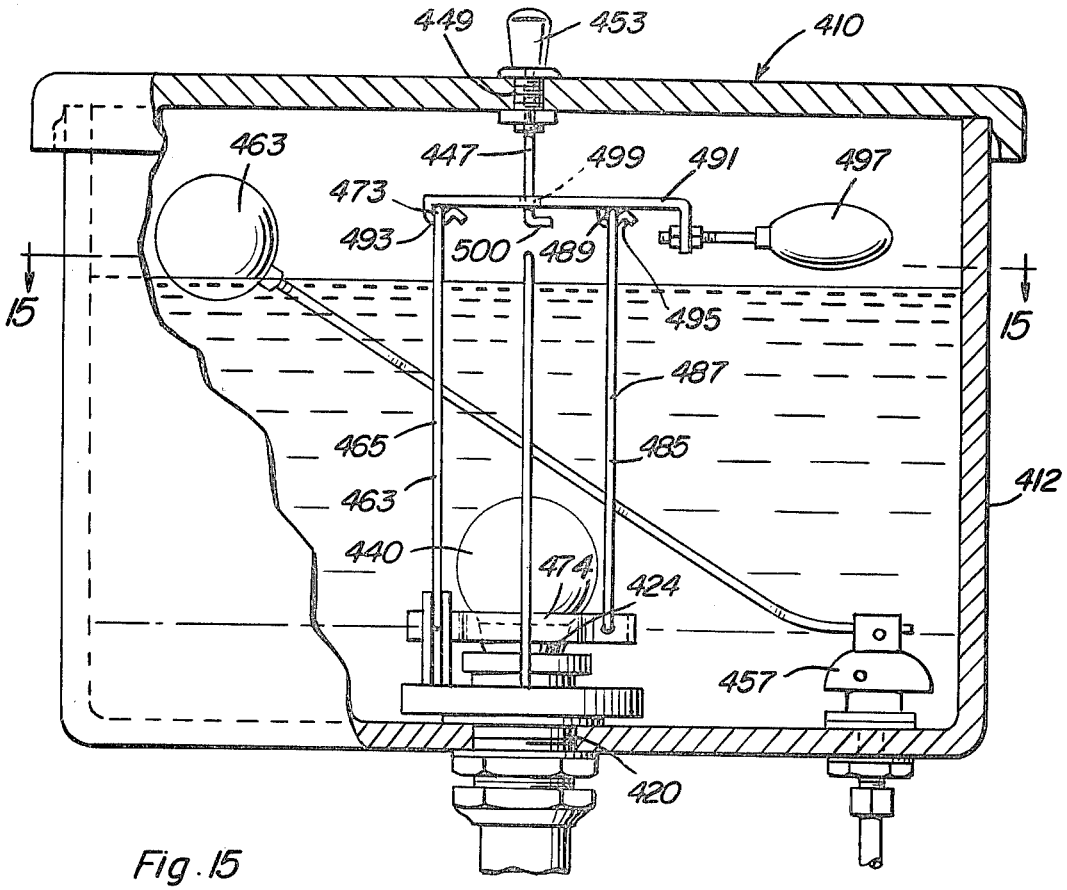
FIG. 14 is a front elevational view of a fifth form of flush tank construction with portions of the tank being broken away and illustrated in vertical section.
Figure 15:
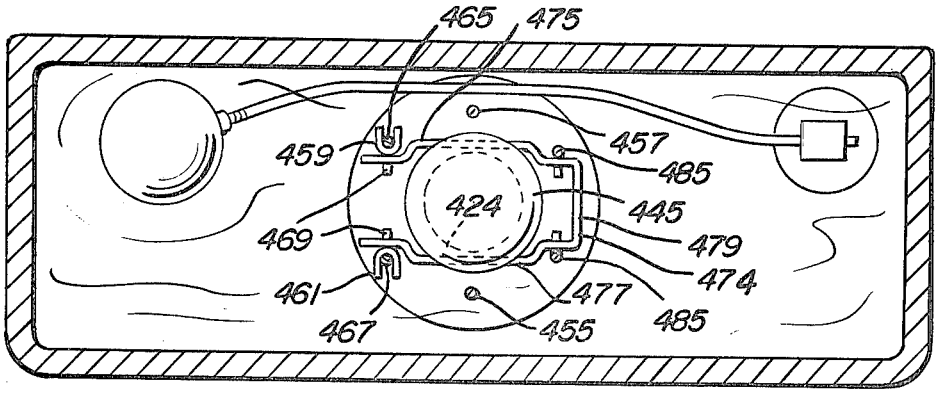
FIG. 15 is a horizontal sectional view taken substantially upon the plane indicated by the section line 15—15 of FIG. 14.
Figure 16:
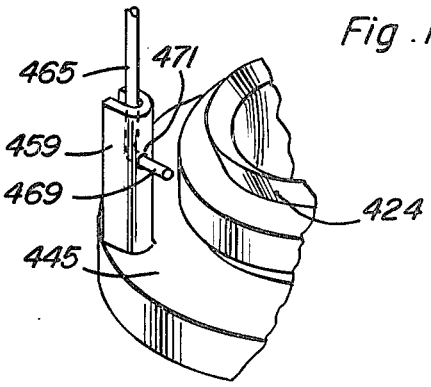
FIG. 16 is a fragmentary enlarged perspective view of one pivotal mounting portion for the valve ball lifting structure illustrated in FIGS. 14 and 15.
Figure 17:
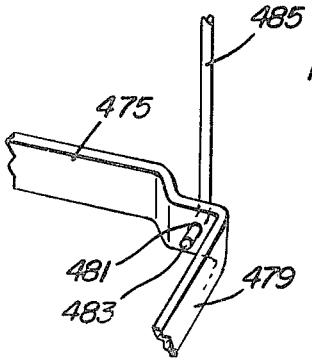
FIG. 17 is a fragmentary enlarged perspective view of the convection of the actuating mechanism with the valve ball lifting structure.

However, the outlet fitting 420 includes a pair of front and rear stationary upstanding rods 455 and 457 and a pair of front and rear upstanding mounts 459 and 461 disposed to the left of the valve seat 424 as view in FIGS. 14 and 15. An inverted U-shaped support 463 including a pair of depending legs 465 and 467 is provided in the lower ends of the legs 465 and 467 include horizontally inturned lower terminal ends 469 removably received through bores 471 formed in the upper end portion of the upright mounts 459 and 461, the mounts defining upstanding U-shaped channel members opening away from each other and in whose upper ends the lower ends of the legs 465 and 467 are embracingly received. The upper ends of the legs 465 and 467 are interconnected by means of a horizontal bight portion 474 extending therebetween.

A horizontally disposed generally U-shaped valve ball lift frame 473 is provided and includes a pair of generally parallel legs 475 and 477 pivotally mounted at one pair of corresponding ends on the terminal ends 469 and joined at the other pair of corresponding ends thereof by means of a bight portion 479 extending therebetween. The ends of the legs 475 and 477 adjacent the bight portion 479 include transverse bores 481 formed therethrough and lower inturned terminal ends 483 of generally parallel depending legs 485 of an inverted U-shaped frame 487 are pivotally received through the bores 481. The upper ends of the legs 485 are interconnected by means of a bight portion 489 extending therebetween and an elongated lever 491 has one end thereof pivotally attached to the bight portion 473 as at 493, a longitudinal midportion thereof pivotally connected to the bight portion 489 at 495 and is provided with a float 497 on its other end. The lower end of the rod 447 extends downwardly through a passage 499 formed in the lever 491 intermediate the pivot points 493 and 495 and includes a laterally directed lower terminal end 500 preventing upward withdrawal of the rod 447 through the passage 449. Accordingly, it will be seen that the operation of the flush tank construction 410 is substantially identical to the operation of the flush tank construction 310 in that the knob 453 may be raised in order to effect upward swinging of the right hand portion of the frame 474 in order to unseat the ball 440 from the seat 424. Of course, the ball 440 is held captive between the rods 455 and 457 and the legs 465, 467 and 485. Further, should the valve member 457 fail to completely terminate the inflow of water into the interior of the flush tank 412, the level of water within the tank 412 will raise above the level thereof illustrated in FIG. 14 to exert an upward buoyant force on the float 497. This, of course, will cause the lower terminal end 500 of the rod 447 to lift upwardly on the lever 491 and to effect at least partial upward unseating of the valve ball 440 from the seat 424.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A flush tank having a lower outlet opening upwardly into said tank and a free buoyant valve ball in said tank for seating engagement in said outlet from above to close the latter, float controlled water inlet means for said tank operative to admit water into said tank in response to the level of water therein dropping below a predetermined level, first and second inverted U-shaped members each including a pair of upstanding generally parallel legs interconnected at their upper ends by means of a connecting bight portion extending and connecting therebetween, said inverted U-shaped members being disposed in generally parallel relation on opposite sides of said outlet, the lower ends of the legs of said first member being stationarily supported relative to said outlet, a third horizontal U-shaped member including a pair of generally parallel legs interconnected at one pair of corresponding ends by a bight portion extending therebetween, said third member being pivotally supported within said tank for oscillation about an axis extending between the lower and free ends of the legs of said first and third members, respectively, with the longitudinal midportions of the legs of said third member disposed closely beneath lower opposite side portions of said ball valve and comprising valve ball displacement means for selectively displacing said valve ball upwardly from seated engagement in said outlet, the lower ends of the legs of said second member being pivotally attached to opposite side portions of said third member adjacent the bight portion thereof, an elongated horizontal lever, means pivotally attaching one end of said lever to the bight portion of said first member, means pivotally anchoring a midportion of said lever to the bight portion of said second member, a float carried by the other end of said lever, and a pair of upstanding rods disposed on opposite sides of said outlet intermediate corresponding legs of said first and second members and stationarily supported relative to said outlet, said rods and legs comprising vertical guide members operative to guide said ball to position for seating in said outlet as the water level in said tank drops after said ball has been unseated from said outlet and allowed to float to the surface of said water.

2. The combination of claim 1 wherein said water inlet means opens upwardly through the bottom of said tank and includes a tubular upstanding fitting sealingly secured through said bottom wall, a downwardly opening inverted cup-shaped valve member pivotally supported from said fitting for oscillation about an axis closely adjacent the center axis of the water inlet passage extending through said fitting between an open position shifted toward one side of and cocked upwardly away from the upper end of said fitting and a closed position substantially centered over and downwardly sealingly engaged with the upper end of said fitting to close the latter, said inlet float being supported from said valve member and operative to shift the latter to said closed position in response to the level of water in said tank being increased to said predetermined level.

3. The combination of claim 2 wherein the valve member includes a downwardly facing resilient seal member engaged with and closing the upper end of said fitting when said valve member is in said closed position.

4. The combination of claim 2 wherein the lower end of said inverted cup-shaped valve member defines a wide discharge area of inlet water into said tank to thereby reduce the velocity of and noise generated by water being discharged into said tank from the interior of said inverted cup-shaped valve member.

5. The combination of claim 1 wherein said lower outlet opens upwardly through an annular seat member constructed of resilient material and including an upwardly tapering and flared flange defining an annular seat of concave spherical configuration having a radius of curvature substantially equal to the radius of curvature of said valve ball.

6. The combination of claim 1 wherein said tank includes a removable upper top wall, an upstanding passage formed through said top wall, an upstanding operating rod slidably received through said passage and connected at its lower end to said lever intermediate its opposite ends.

7. The combination of claim 6 wherein said operative rod includes a lost motion connection with said lever.

* * * * *